United States Patent [19]

Dudley et al.

[11] Patent Number: 4,749,360

[45] Date of Patent: Jun. 7, 1988

[54] ELECTRICAL WALL OUTLET

[76] Inventors: Cheatham T. Dudley, 1533 Walton, Rochester, Mich. 48063; William J. Cauley, 60483 Apache La., Washington, Mich. 48094

[21] Appl. No.: 96,764

[22] Filed: Sep. 11, 1987

Related U.S. Application Data

[63] Continuation of Ser. No. 868,949, May 30, 1986, abandoned.

[51] Int. Cl.[4] ..... H01R 13/453

[52] U.S. Cl. ..... 439/137

[58] Field of Search ..... 439/92, 137–140

[56] References Cited

U.S. PATENT DOCUMENTS

| | | | |
|---|---|---|---|
| 2,579,538 | 12/1951 | Bierce | 339/40 |
| 3,206,705 | 9/1965 | Smith | 339/40 X |
| 3,327,277 | 6/1967 | Ramsing | 339/14 R |
| 3,736,547 | 5/1973 | Koenig | 339/14 R |
| 4,072,382 | 2/1978 | Rescake | 339/40 |
| 4,168,104 | 9/1979 | Buschow | 339/40 |
| 4,201,131 | 5/1980 | McDonald | 339/14 P |
| 4,293,172 | 10/1981 | Lingaraju | 339/14 P |
| 4,493,517 | 1/1985 | Hillary | 339/42 |

FOREIGN PATENT DOCUMENTS

| | | | |
|---|---|---|---|
| 214335 | 3/1958 | Australia | 339/40 |
| 792363 | 3/1958 | United Kingdom | 339/40 |
| 793000 | 4/1958 | United Kingdom | 339/40 |
| 1429692 | 3/1976 | United Kingdom | 339/38 |

*Primary Examiner*—Eugene F. Desmond

*Attorney, Agent, or Firm*—Brooks & Kushman

[57] ABSTRACT

A device for closing female apertures in an electrical receptacle and opening those apertures responsive to mechanical engagement of a male prong of a plug, having prongs operable for insertion into the receptacle.

12 Claims, 2 Drawing Sheets

FIG. 1
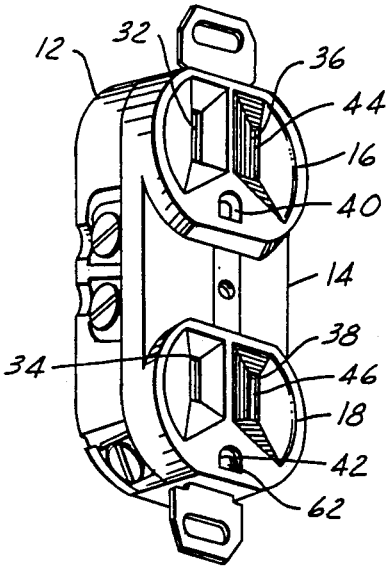
FIG. 2
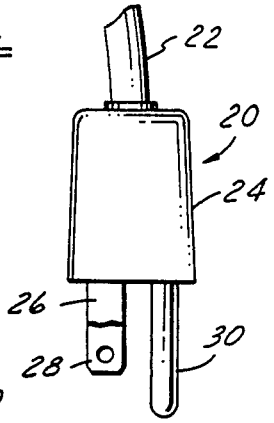
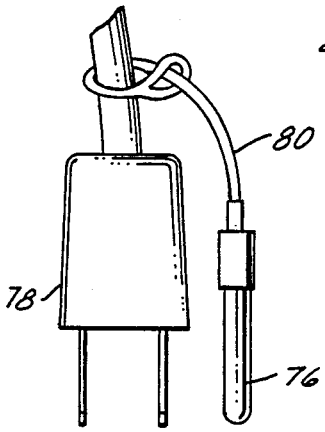
FIG. 3
FIG. 4
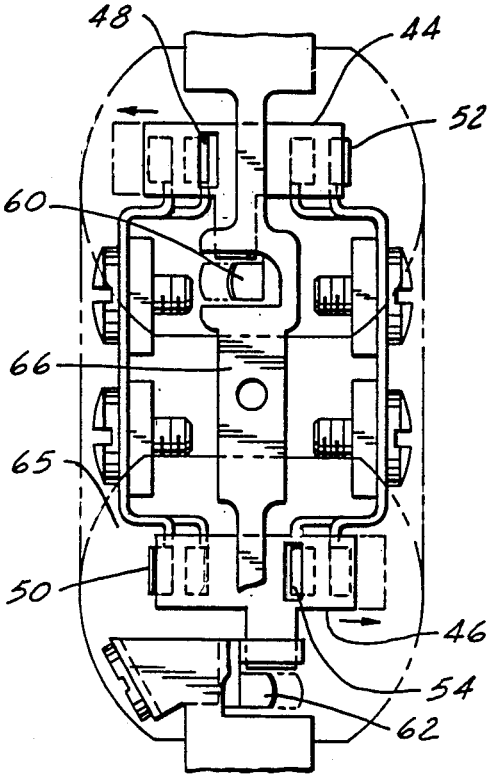
FIG. 5
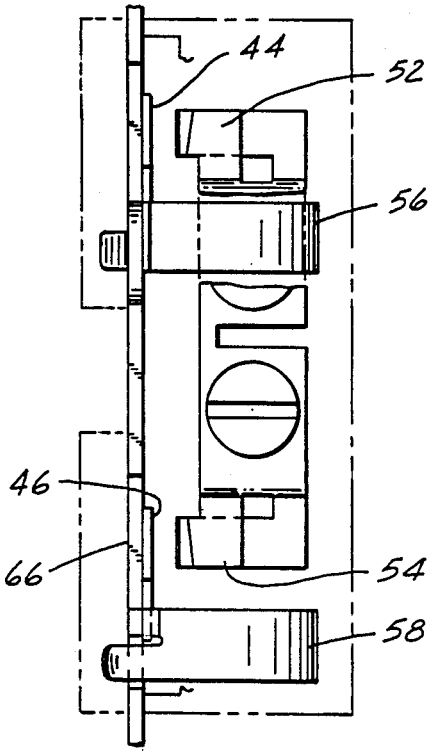

FIG.6
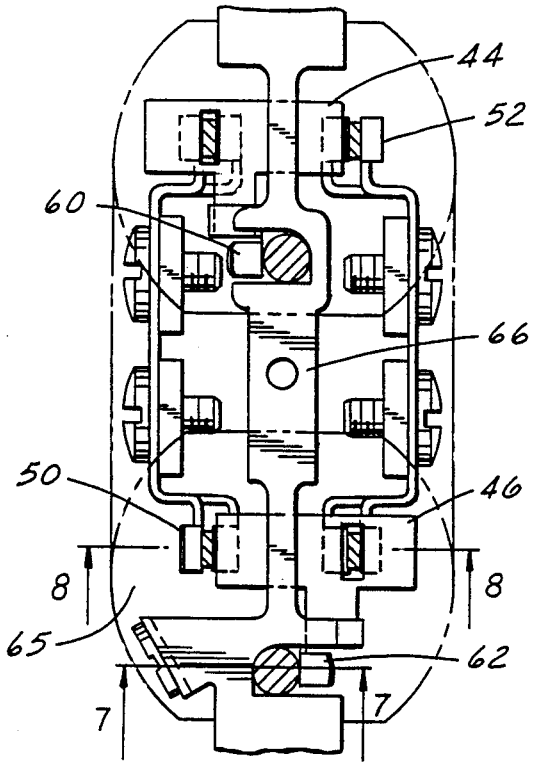
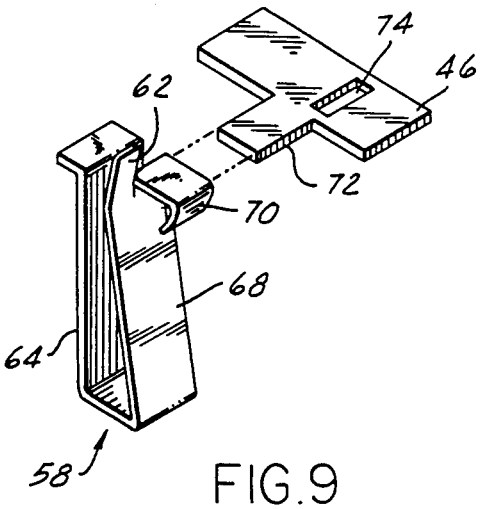
FIG.9
FIG.7
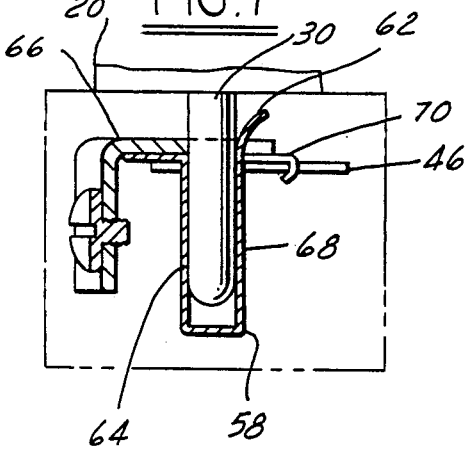
FIG.8
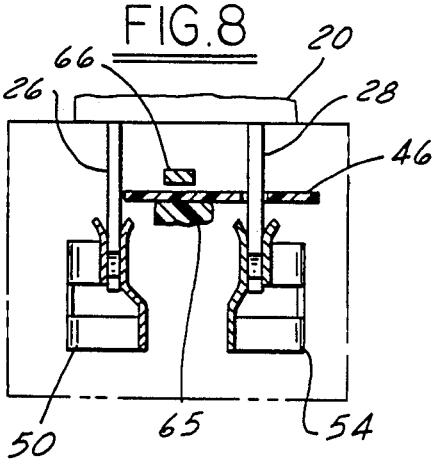

ELECTRICAL WALL OUTLET

This application is a continuation of application Ser. No. 868,949, filed May 30, 1986, now abandoned.

FIELD OF INVENTION

This invention relates to an electrical receptacle. More particularly, this invention relates to an electrical receptacle that can be opened or closed responsive to mechanical engagement of a male prong of a plug that can be received into the receptacle.

BACKGROUND AND OBJECTS OF INVENTION

In the past, a number of devices have been devised to address the problem of safety in connection with electrical receptacles. One problem that has been addressed is the problem of infants and small children making contact with metal electrical conduits within a receptacle by insertion of either their fingers or metal objects into the holes in such receptacles that are needed to receive the male prongs of a plug. Without some method of inhibiting such contact, an infant or small child can suffer serious injury.

One method that has been addressed in the past is to provide a non-conducting plug having non-conducting prong members inserted into receptacle. Such devices are often difficult for a less dextrous infant or child to pull out, but can be readily removed by an adult with a little effort. In either case, that is, either the infant or the adult, it is possible to remove this blocking plug and still expose the person to danger. One of the problems with this method is the fact that not only is the blocking non-conducting plug removable, but is easily removable by an adult and does not prevent an adult from being shocked when inserting a male plug into the receptacle. This problem is aggravtated when there is no ground circuit which often occurs during the active insertion because the ground circuit is not complete until insertion is complete, or there may be no provision for a ground blade in the plug being inserted.

A number of other devices have been addressed in the past to the problem of insuring that there are electrical conduit members for grounding a circuit. These devices often provide a spring or springs, linkages, and sometimes even solenoids and relays to achieve this objective.

One of the problems of these devices is that they do not insure that there will be no electricity flowing into a device when there is no ground prong on the plug of such a device.

Accordingly, it is an object of this invention to prevent electrical conduction unless there is a male grounding prong on the plug of the electrical device to be inserted into a receptacle.

It is a further object of this invention to provide a means of blocking, by an electrically non-conductive member, the apertures in an electrical receptacle responsive to removal of a male plug therefrom.

It is another object of this invention to open an otherwise blocked aperture in the electrical outlet responsive to insertion of an electrical male plug thereinto.

It is another object of this invention to provide means preventing even accidental contact with electrically active metal conducting members of an electrical receptacle with any external objects while allowing the unblocking of same only upon insertion by a prong of a male plug into the ground plug receptacle thereof.

It is another object of this invention to provide a safety electrical receptacle that insures that no electrical contact is made unless the male plug being inserted thereinto has a prong as part of a ground circuit.

These and other objects of this invention are achieved by the provision of a member having electrically non-conductive components blocking the aperture for access to electrical conducting members within a receptacle; said member operable to move mechanically responsive to engagement in a camming action with the ground prong of a male plug. The movement generated by this camming action moves the non-conductive component out of a blocking position with respect to the aperture so that the prongs of the plug operable to carry the energy to the device to be energized can pass into the aperture and come into mechanical and electrical contact with the electrically conductive components of the receptacle.

The above provides structures that are tamperproof, dustproof, dusttight, raintight, and weatherproof as defined by Article 100 of the "National Electrical Code 1984", as published by National Fire Protection Association, Battermarch Park, Quincy, Mass. The above apparatus also provides a dead front receptacle as defined by Section 70-8 of the "National Electrical Code". By "dead front" is meant in this context, without electrically live parts exposed to a person on the operating side of the equipment.

Also provided by this apparatus is a dustproof receptacle as defined by Section 70-8 of the "National Electrical Code". Specifically, "dustproof" means, in this context, so constructed or protected that dust will not interfere with its successful operation. Also provided by this apparatus is a dusttight receptacle as defined by Section 70-8 of the "National Electrical Code". "Dusttight" means, in this context, so constructed that dust will not enter the enclosing case under specified test conditions.

Also provided by this apparatus is an unexposed receptacle where the term "exposed" is that used in Section 70-9 of Article 100 of the "National Electrical Code". Specifically, in this context, "exposed" means, as applied to live parts, capable of being inadvertently touched or approached nearer than a safe distance by a person. It is applied to parts not suitably guarded, isolated, or insulated.

What is provided is an apparatus for a damp location that is rainproof and raintight, where the terms damp location, rainproof, and raintight are that provided by the definitions in Article 100 of the "National Electrical Code". Specifically, a receptacle shall be considered to be in a damp location in partially protected locations under roofed open porches, canopies, marquees, and like locations, and interior locations subject to moderate degrees of moisture, such as some basements, some barns, and some cold-storage warehouses. In this context, "rainproof" means so constructed, protected, or treated as to prevent rain from interfering with the successful operation of the apparatus under specified test conditions. In this context, "raintight" means so constructed or protected that exposure to a beating rain will not result in the entrance of water under specified test conditions.

This apparatus also provides a weatherproof receptacle as defined in Section 70-16 of Article 100 of the "National Electrical Code". In this context, "weatherproof" means so constructed or protected that exposure to the weather will not interfere with successful operation. Rainproof, raintight, or watertight equipment can fulfill the requirements for weatherproof where varying weather conditions other than wetness, such as snow, ice, dust, or temperature extremes, are not a factor.

Also provided is a grounding type receptacle or receptacle to be grounded where the definitions of "grounding type" and "to be grounded" are those found in Article 210 of the "National Electrical Code".

SUMMARY OF THE INVENTION

An electrical receptacle for removably receiving an electrical plug having a ground prong and two or more conductor prongs. The electrical receptacle is provided with a body having at least one outlet having a ground plug aperture and apertures to receive the conductor prongs of the plug. Within the body is an aperture shield which blocks the conductor prong apertures. The aperture shield is in the normally closed position and may be shifted to the open position to allow insertion of the conductive prongs of the plug. The device is further provided with a mechanism for shifting the aperture shield to the open position in response to the insertion of the ground prong into the ground prong aperture of the body.

BRIEF DESCRIPTION OF THE DRAWINGS

FIG. 1 is a perspective view of the preferred embodiment of the invention;

FIG. 2 is partial cutaway side elevation of a standard three-prong male plug;

FIG. 3 is a partial cutaway side elevation of a standard two-prong male plug having a dummy ground prong attached thereto;

FIG. 4 is a cutaway plan view of the preferred embodiment of the invention with the aperture shield shown in the closed position;

FIG. 5 is a cutaway side elevation of the invention;

FIG. 6 is a cutaway plan view of the invention with the aperture shield shown in the open position;

FIG. 7 is a cross-sectional view of the invention taken along line 7—7 in FIG. 6;

FIG. 8 is a cross-sectional view of the invention taken along line 8—8 in FIG. 6; and FIG. 9 is an exploded perspective view of the ground spring and aperture shield.

BRIEF DESCRIPTIVE OF THE PREFERRED EMBODIMENT

Before explaining the present invention in detail, it is to be understood that the invention is not limited in this application to the details and construction and arrangement of the parts illustrated in the accompanying drawings since the invention is capable of other embodiments and of being practiced and carried out in various ways.

Referring to the drawings, FIG. 1 shows an electrical receptacle 10 which is similar in general appearance to a standard two-outlet electrical wall receptacle designed to receive a conventional 110-volt, three-prong grounded male plug. The electrical receptacle 10 is provided with housing 12 and a face plate 14 formed in a conventional manner of an insulating material. The face plate is provided with two generally oval outlets, upper outlet 16 and lower outlet 18. Each outlet is provided with three apertures to receive the three prongs of a standard 110-volt grounded male plug. A typical standard grounded male plug 20 is shown in FIG. 2. Plug 20 is attached to an insulated three conductor cord 22 which is attached to plug body 24 and each of the three conductors is independently electrically connected to these three electrical contact prongs: first blade 26, second blade 28 and cylindrical ground 30.

The plug of the type shown in FIG. 2 may be installed in either or both of the two outlets formed in electrical receptacle 10. Both of the upper and lower outlets are provided with three apertures to receive the prongs of plug 20. The upper and lower outlets are provided with a first aperture 32 and 34, a second aperture 36 and 38 and a ground aperture 40 and 42. The first and second apertures are generally rectangular as shown. Traditionally, the first aperture is somewhat longer than any second aperture so that a non-grounded two-prong plug will be installed in proper blade orientation.

As shown in FIG. 2, a cylindrical ground 30 is significantly longer than blade 28. Blades 26 and 28 are of the same length. Blade 26 is partially cut away so that both blades may be seen in the side elevation. When plug 20 is inserted in the electrical receptacle, cylindrical ground plug prong 30 will enter ground aperture 40 or 42 prior to blades 26 and 28 entering into their corresponding apertures.

When there is no plug installed in the electrical outlet as shown in FIG. 1, apertures 32 through 38 are sealingly blocked by an internal aperture shield 44 and 46 which are only partially visible through the aperture in FIG. 1. FIG. 4 shows a plan view of the electrical receptacle with the housing and face plate as shown only in phantom view so as to expose the internal mechanism. Aperture shields 44 and 46 are more clearly shown in FIG. 4. The aperture shield is slidably mounted to the receptacle between support 65 and the ground bar 66 to allow transverse movement in the direction of the arrow. The aperture shields are made preferably of an insulating material such as nylon.

In FIG. 4 the aperture shields are shown in the closed position. The aperture shield blocks the first and second aperture in each outlet thereby preventing the insertion of any foreign objects into the electrically active apertures of the outlets, first electrical contact 48 and 50 as well as second electrical contacts 52 and 54. As shown in FIGS. 1, 4–6, the first and second electrical contact 48–54 are orientated directly below the first and second apertures 32–38. With the aperture shield in the closed position as shown in FIG. 4, the apertures are obstructed by the aperture shield. When the cylindrical ground prong 30 is inserted in the ground aperture 40 or 42 of the outlet, the ground prong will engage ground spring 56 or 58, respectively. Both ground springs are provided with an arcuate-shaped tang 60 and 62, respectively. Ground springs 56 and 58 are generally U-shaped as best shown in FIGS. 7 and 9. The two springs used in the preferred embodiment are mirror images of one another and function idenically. Examining that used for outlet 18, the U-shaped ground spring is provided with a fixed side 64 which is spot welded to ground bar 66. The ground spring is further provided with a free side 68 having at its upper end an arcuate tang 62 and aperture shield retainer 70. The cooperation between the aperture shield and the ground spring is clearly shown in FIG. 9. The ground spring is fabricated in such a manner that the free side 68 is relatively close to fixed side 64 when the plug is not inserted in the outlet. When the ground prong 30 is inserted, the ground prong elastically deflects the ground spring free side thereby shifting the aperture shield from the closed to the open position. Note the position of the tang aperture spring in FIG. 4 when the aperture shield is in the closed position. When the ground prong is inserted as shown in FIGS. 6 and 7, the tang on the aperture spring is deflected causing the aperture shield to shift laterally. Once the aperture shield is moved to the unobstructed position, the plug may be completely inserted into the outlet following the blades of the plug to engage first and second electrical contacts 48-54 as shown in FIG. 8. Upon removal of the plug from the outlet, the ground spring via inherent elasticity automatically returns to its initial position, shown in FIG. 4, causing the aperture shield to return to the closed position obstructing the insertion of foreign objects into the first and second apertures of the outlet. The ground spring serves as a means for shifting the aperture shield from a closed position to an open position in response to the insertion of a ground prong or other object into the ground plug aperture.

The design of the aperture shield is best seen in FIG. 9 which shows the shield corresponding to aperture 38 in receptacle 18. The shield is a thin generally rectangularly shaped plate with a lug 72 projecting therefrom. Lug 72 cooperates with retainer 70 of the ground spring. The rectangular portion of the aperture shield is further provided with an opening 74 sized to correspond with aperture 38. When the aperture shield is in the closed position as shown in FIG. 4, the opening in the aperture shield 74 is not aligned with aperture 38. When the aperture shield is moved to the open position as shown in FIG. 6, the opening in the aperture shield is oriented in such a manner so that the second blade 28 of the plug 20 may be inserted through aperture 38 in the outlet through opening 74 in the aperture shield and into cooperating relation with second electrical contact 54. As may be seen from FIG. 4, when the ground plug is inserted, the shield 46 moves slidably in the direction of the arrow so that it no longer covers electrical contact 50 and 54. Thus, by insertion of the ground prong 30, both electrical contacts are exposed for insertion of blades 26 and 28 of plug 24 as shown in FIGS. 6–8.

When electrical receptacle of the present design is used there may from time to time be the need to install a electrical plug having only two connectors. In order to shift the aperture shield to the open position, it is necessary to insert a dummy ground prong into the ground aperture of the cover. Preferably, the dummy ground prong will be of the design generally shown in FIG. 3 having attachment means 80 for connecting the dummy ground 76 immediately adjacent to prong plug 78. With the dummy ground attached to the adjacent plug when the electrical device is unplugged, the dummy ground will be removed from the outlet allowing the aperture shield to return to the closed position. The attachment means shown in the FIG. 3 embodiment is an integrally molded flexible loop so the dummy ground can be conveniently affixed to an electrical cord adjacent to plug. The dummy ground and the attachment loop can be integrally molded of a non-conductive plastic material.

It should be understood that the aperture shield not only serves to minimize the likelihood of electrical injury to children but the shield by obstructing the apertures of the unused outlets minimized the amount of water or dust or other foreign objects that could impair the function of the device.

It should be further understood that the two outlet embodiment of the invention as shown in the drawings is shown for the purpose of disclosing a typical application. The invention could as easily be used in conjunction with a single outlet receptacle or a typical sixth outlet strip, as is commonly used on some extension cords. Further, the invention is not lmited in application to three-prong 120-volt AC connectors. Various embodiments of the invention can be readily designed to accommodate other applications such as three-prong 220-volt connectors and three phase.

We claim:

1. An electrical receptacle for removably receiving an electrical plug having at least two parallel electrically conductive planar blades, said electrical receptacle comprising:

a body having an internal cavity, a ground prong aperture and at least two apertures for receiving the electrically conductive blades of an electrical plug, said apertures extending into said internal cavity;

an aperture shield located within said body internal cavity formed of a rigid nonconductive material, said aperture shield being slidably shiftable in a transverse direction relative to the body generally perpendicular to said blades along a line connecting the conductive prongs, between a closed position wherein the electrically conductive blade apertures are obstructed, to an open position wherein said apertures are unobstructed; and a ground spring having two ends, a fixed end attached to said body and a free end cooperating with the aperture shield and a ground prong shaped object to be inserted into the ground prong aperture, said ground spring maintaining the aperture shield in a normally closed position and elastically deforming transversely upon the insertion of the object into the ground prong aperture causing the aperture shield to slide to the open position and automatically returning to the closed position upon withdrawal of the object.

2. The invention of claim 1 wherein said aperture shield is further provided with at least one opening formed therein of sufficient size to allow an electrically conductive blade of the plug to pass therethrough.

3. The invention of claim 1 wherein said aperture shield is provided with a lug which projects therefrom for cooperation with the free end of the ground spring.

4. The invention of claim 3 wherein said ground spring is generally U-shaped having a free end retaining said aperture shield lug.

5. The invention of claim 4 wherein the ground spring free end is further provided with an arcuate-shaped tang to enable the ground prong shaped object to be easily inserted into the ground prong aperture.

6. The invention of claim 4 wherein the aperture shield lug projects from the aperture shield generally perpendicular to the plane of a conductive blade, and said ground spring free end is further provided with a hook shaped retainer for engaging the lug to shift the aperture shield to a selected position.

7. An electrical receptacle for removably receiving an electrical plug having a ground prong and at least two electrically conductive prongs, at least one of which is a planar shaped blade, said electrical receptacle comprising:

a body having an internal cavity, a ground prong aperture and at least two apertures for receiving the electrically conductive blades of an electrical plug, said apertures extending into said internal cavity;

an aperture shield formed of a rigid nonconductive material, cooperating with said body and located within the internal cavity, said aperture shield being slidingly shiftable in a transverse direction perpendicular to the plane of the planar shaped blade along a line between said conductive prongs, between a closed position wherein the conductive prong apertures are obstructed by the aperture shield, to an open position wherein said conductive prong apertures are unobstructed thereby; and a generally U-shaped ground spring having a fixed side attached to said body and a free side elastically deflectable in the transverse direction relative thereto in response to the insertion of an object into the ground prong aperture, said free side having a free end which cooperates with said aperture shield to shift same between said open and closed position.

8. The invention of claim 7 wherein said aperture shield is further provided with at least one opening formed therein of sufficient size to allow an electrically conductive prong of the plug to pass therethrough.

9. The invention of claim 8 wherein said aperture shield is further provided with a lug which projects therefrom for cooperation with the ground spring and said ground spring is further provided with a formed end for telescopically receiving said lug.

10. The invention of claim 9 wherein the ground spring free side is further provided with an arcuate-shaped tang to enable an object to be easily inserted into the ground prong aperture.

11. A dummy ground prong to be attached to an electricl plug and cord assembly to allow a user to insert a groundless plug in an electrical receptacle provided with an internal aperture shield operated by the plug ground, said dummy ground prong comprising:

an elongated dummy prong formed of a non-conductive material and having the general shape of a ground prong of an electrical plug to allow insertion into an electrical receptacle ground prong aperture; and an elongated flexible attachment having two ends for affixing the dummy prong to the plug and cord assembly, wherein the first end is attachable to the cord and the second end is affixed to said dummy prong for insertion by the user into the electrical receptacle ground prong aperture to shift the internal aperture shield, thereby allowing the plug attached thereto to be inserted into the electrical receptacle.

12. The invention of claim 11 wherein said elongated flexible attachment and said ground prong are integrally formed of a single piece of plastic and said attachment first end is further provided with means of attaching to the plug cord assembly.

* * * * *

UNITED STATES PATENT AND TRADEMARK OFFICE

CERTIFICATE OF CORRECTION

PATENT NO. :4,749,360

DATED :June 7, 1988

INVENTOR(S) :C. Truman Dudley & William Cauley

It is certified that error appears in the above-identified patent and that said Letters Patent is hereby corrected as shown below:

In the Claims:

In claim 11, column 8, line 6, please delete the word "electricl" and insert in its place the word ---electrical---.

In claim 11, column 8, line 10, please delete the word "non-conductive" and insert in its place the word ---nonconductive---.

Signed and Sealed this

Seventh Day of February, 1989

*Attest:*

DONALD J. QUIGG

*Attesting Officer*

*Commissioner of Patents and Trademarks*